US007040206B2

(12) United States Patent
Wang

(10) Patent No.: US 7,040,206 B2
(45) Date of Patent: May 9, 2006

(54) STRADDLE SAFETY PUSHER SYSTEM

(75) Inventor: Henry Wang, Winter Springs, FL (US)

(73) Assignee: Micro Jig, Inc., Winter Springs, FL (US)

( * ) Notice: Subject to any disclaimer, the term of this patent is extended or adjusted under 35 U.S.C. 154(b) by 200 days.

(21) Appl. No.: 10/051,556

(22) Filed: Jan. 17, 2002

(65) Prior Publication Data

US 2002/0178888 A1 Dec. 5, 2002

Related U.S. Application Data

(60) Provisional application No. 60/295,378, filed on Jun. 1, 2001.

(51) Int. Cl.
*B27B 25/00* (2006.01)

(52) U.S. Cl. ..... 83/436.2; 83/438; 83/437.2

(58) Field of Classification Search ..... 83/436.2, 83/437.2, 431, 438, 446, 435.11, 437.1, 435; 144/242.1, 216, 217, 204.2, 203, 2.44, 250.18, 144/253.8, 253.5, 247.7, 245.6, 245.2; 269/156, 269/43; 30/159; 16/422, 426, 430, DIG. 39
See application file for complete search history.

(56) References Cited

U.S. PATENT DOCUMENTS 751,121 A * 2/1904 Tidey ..... 269/315
1,032,278 A * 7/1912 England ..... 144/253.8
1,710,718 A * 4/1929 Stotz ..... 269/156
2,134,606 A * 10/1938 Hackworth et al. ..... 108/27
2,410,467 A 11/1946 Valentine
2,522,965 A * 9/1950 Schaufelberger ..... 83/409
2,620,929 A * 12/1952 Sportsman ..... 108/28
2,754,857 A * 7/1956 Herbert ..... 83/478
2,839,100 A 6/1958 Valicenti
2,895,513 A * 7/1959 Cowley ..... 83/435.14
2,929,419 A * 3/1960 Johnson ..... 83/435.11
4,001,903 A 1/1977 Hay
4,066,250 A * 1/1978 Campbell ..... 269/43
D248,144 S * 6/1978 Kreitz ..... D8/14
4,348,925 A 9/1982 Manweiler (Continued)

*Primary Examiner*—Allan N. Shoap
*Assistant Examiner*—Omar Flores-Sánchez
(74) *Attorney, Agent, or Firm*—David G. Maire; Beusse Wolter Sanks Mora & Maire, P.A.

(57) ABSTRACT

An adjustable pushing apparatus (50) for safely moving a work piece (22) past a cutting tool (16). The apparatus includes a body (52), a first leg (56), a second leg (58) and a moveable center leg (60) defining a leg side surface (74) and two adjustable-width tunnels (62, 64) through which a cutting tool may pass. A handle (54) is moveable along a top surface (82) of the body to provide a balance of forces on both the inside cut portion (24) and the outside cut portion (26) of the work piece. Non-slip work piece-contacting surfaces (76) provide positive engagement with the work piece. A spacer (84) may be attached to either leg at a plurality of vertical heights to balance the apparatus when the work piece is too narrow to make contact with a work piece-contacting surface on both side of the cut line (C). A dust shield (120) attaches to the handle keyways at two alternative locations. A tapering device (144) attaches to the apparatus for making taper cuts. The tapering device includes two memory stops for quickly changing between two selected cut angles. The tapering device may function as a connector between two pushing body structures for guiding a long piece of stock material past a cutting device.

4 Claims, 12 Drawing Sheets

U.S. PATENT DOCUMENTS 4,370,909 A 2/1983 Jennings
4,432,263 A * 2/1984 Kowalchuk ..... 83/438
4,476,757 A * 10/1984 Morris ..... 83/446
4,485,711 A 12/1984 Schnell
D278,022 S 3/1985 Ash
D278,790 S 5/1985 Chaney et al.
4,603,612 A 8/1986 Atkins
5,016,509 A 5/1991 Stottman
5,140,778 A 8/1992 Carruth
D342,658 S * 12/1993 Gakhar et al. ..... D8/71
5,330,167 A * 7/1994 Plumb ..... 269/43
5,341,711 A 8/1994 Stay, Jr. et al.
5,662,019 A 9/1997 Denman
5,678,467 A 10/1997 Aigner
5,875,827 A 3/1999 Brutscher et al.
5,894,777 A 4/1999 Sterling
6,044,740 A 4/2000 Werkheiser
6,098,972 A * 8/2000 Klimach et al. ..... 269/156
6,135,521 A 10/2000 Wirth, Jr. et al.
6,164,176 A * 12/2000 Larsson ..... 83/435.12
6,196,283 B1 * 3/2001 Hundegger ..... 144/3.1
6,382,608 B1 * 5/2002 Michell ..... 269/6
6,491,073 B1 * 12/2002 Essick ..... 144/144.51
6,732,623 B1 * 5/2004 Jennings ..... 83/436.2

* cited by examiner

STRADDLE SAFETY PUSHER SYSTEM

This application claims benefit of the Jun. 1, 2001, filing date of U.S. provisional patent application Ser. No. 60/295,378.

FIELD OF THE INVENTION

This invention relates generally to the field of woodworking tools, and more particularly to the field of accessories for feeding stock safely across a saw table.

BACKGROUND OF THE INVENTION

A table saw typically includes a flat, horizontally oriented table having an opening formed therein through which a top portion of a circular saw blade protrudes. The saw blade may be 10–12 inches in diameter, for example, and is motor driven to rotate at a speed of 3,000 revolutions per minute or more. A piece of stock material, typically wood, may be cut by moving it across the table to intersect the spinning saw blade. The height of the top of the saw blade above the table may be adjustable within predetermined limits in order to accommodate stock material of various thicknesses.

A fence is provided with a table saw to guide the movement of the stock in a direction parallel to the plane of the saw blade in order to ensure a straight cut and to avoid binding of the non-cutting portions of the saw blade within the stock material. A fence typically includes an elongated metal bar having a flat guide face oriented at a right angle with respect to the table and parallel to the plane of the saw blade. The distance between the fence guide face and the saw blade may be adjustable within predetermined limits in order to accommodate stock material and cut locations having various widths.

It is known to use a push stick to urge the stock material past the saw blade in order to keep the operators fingers at a safe distance from the dangerous rotating blade. The most simple push stick may be simply an elongated piece of excess stock material that is urged against the work piece. A more sophisticated push stick is described in U.S. Pat. No. 6,135,521 as including an ergonomically designed handle, two stepped portions for engagement with the work piece, and non-slip pads for better control. While the push stick of the '521 patent does provide a degree of protection for the one hand of the operator, it still requires the operator to touch the work piece with a second unprotected hand. Furthermore, this style of push stick can apply downward force against only the trailing edge portion of the work piece since it engages the rear edge of the work piece with a stepped portion of the stick. Applying downward force only against the trailing edge portion of the work piece may be inadequate to hold the stock material down. A long piece of stock material being urged into a saw blade with such a tool may be lifted away from the table by the lifting action of the rotating saw blade, thus creating a dangerous kick-back condition where the work piece is thrown upward toward the table saw operator.

U.S. Pat. No. 2,839,100 describes a woodworking accessory that engages the work piece along an extended length in order to keep the operator's hands away from the saw blade at all times. This device engages the stock material with a plurality of screws, thus causing undesirable damage to the work piece. While this device provides improved control of the work piece between the saw blade and the fence guide face, it does not provide any control for the severed portion of the work piece on the far side of the blade away from the fence, commonly called the outside cut material. While the outside cut material is often considered the scrap portion of the stock material, it nonetheless may present a danger to the operator if it is not properly restrained during the cutting operation.

U.S. Pat. No. 4,370,909 describes a hand guard for a table saw including a grooved underside adapted to rest on top of the work piece and a vertically moveable heel for engaging the rear edge of the work piece. Here, again, this tool engages the stock material only near its rear edge and is thus ineffective in restraining the leading edge portion of a long piece of stock material. Furthermore, the tool is narrow and must be positioned against the guide fence, so it is useful for removing only a small width of material from the work piece. The tool is designed to exert a pushing force against the work piece. It includes no means for positively forcing the work piece against the guide fence, thus necessitating the use of the operator's second unprotected hand for maintaining pressure against the fence as the work piece is moved past the saw blade.

SUMMARY OF THE INVENTION

Thus, an improved pushing apparatus is needed for moving stock material along a table past a rotating blade in order to provide improved control of the work piece and improved safety for the operator.

An apparatus for guiding a work piece through a cutting device is described herein as including: a body; a first leg attached to the body and extending downward to form a first leg non-slip work piece-contacting surface; a second leg attached to the body and extending downward to form a second leg non-slip work piece-contacting surface; a center leg moveably attached to the body and extending downward between the first leg and the second leg to form a center leg non-slip work piece-contacting surface, the center leg fixable in any one of a plurality of positions; and a handle moveably attached to a top of the body and fixable in any one of a plurality of positions.

In a further embodiment, an apparatus for guiding a work piece through a cutting device is described as including: a body having a top and an underside opposed the top; a first leg attached to the body and forming a first side surface, the first leg extending below the underside of the body to form a first leg work piece-contacting surface; and a center leg attached against the underside of the body and extending below the underside of the body to form a center leg work piece-contacting surface, the center leg moveable to a plurality of positions relative to the first side surface to form a first tunnel having a selected width through which a cutting device may pass, the first tunnel defined by the first leg, the center leg and the underside of the body. The apparatus may further include a spacer removably attached to the first leg and having a spacer side surface remote from the first side surface and having a spacer bottom surface, the spacer attachable to the first leg in a plurality of positions to extend the spacer bottom surface below a plane of the first leg work piece-contacting surface. The spacer may have a non-slip surface and a slip surface opposed the non-slip surface; with the spacer being selectively attachable to the first leg to position one of the slip surface and the non-slip surface as a spacer bottom surface. The apparatus may include a shield comprising a connector to position the shield at a first position relative to the body and a second connector to position the shield at a second position relative to the body. The apparatus may include a tapering device having a first edge extending under the leg closest to the fence to make parallel contact with an edge of the work piece, and a second edge moveable to a plurality of angles with respect to the first edge. The tapering device may include: a bottom plate; a top plate pivotally attached to the bottom plate and fixable at a plurality of angles in relation thereto; a first memory stop connected to the bottom plate for abutting the top plate when it is positioned at a first of the plurality of angles; and a second memory stop connected to the bottom plate for abutting the top plate when it is positioned at a second of the plurality of angles.

In a further embodiment, an apparatus for guiding a work piece through a cutting device is described as including: a structure defining a tunnel through which a cutting device may pass, the structure comprising at least two work piece-contacting surfaces for applying force to a work piece on each of two opposed sides of the cutting device; and a means for adjusting a width of the tunnel to accommodate a plurality of cut geometries. The apparatus may include a means for balancing the structure when the work piece has a width insufficient to make contact with the work piece-contacting surfaces on both opposed sides of the cutting device. The apparatus may further include a means attached to the structure for maintaining an edge of the work piece at a selected one of a plurality of angles with respect to a cut line.

An apparatus for guiding a work piece through a cutting device may include: a structure defining a tunnel through which a cutting device may pass, the structure comprising at least two work piece-contacting surfaces for applying force to a work piece on each of two opposed sides of the cutting device; and a handle attached to the structure and moveably fixable at any one of a plurality of positions along a width of the structure for positioning the handle relative to a line of the cutting device.

An apparatus for guiding a work piece through a cutting device may further include: a structure defining a tunnel through which a cutting device may pass, the structure comprising at least two work piece-contacting surfaces for applying force to a work piece on each of two opposed sides of the cutting device; and a balance support moveably attached to the structure at any one of a plurality of positions to extend a bottom surface to a position below a plane of the at least two work piece-contacting surfaces.

An apparatus for guiding a work piece through a cutting device may include: a structure defining a tunnel through which a cutting device may pass, the structure comprising at least two work piece-contacting surfaces for applying force to a work piece on each of two opposed sides of the cutting device; and each of the at least two work-piece-contacting surfaces comprising a non-slip surface.

An apparatus for guiding an especially long work piece through a cutting device may be embodied as: a first structure defining a first tunnel through which a cutting device may pass, the first structure comprising at least two work piece-contacting surfaces for applying force to a work piece on each of two opposed sides of the cutting device; a second structure defining a second tunnel through which the cutting device may pass after having passed through the first tunnel, the second structure comprising at least two work piece-contacting surfaces for applying force to the work piece on each of two opposed sides of the cutting device; and a bridge connecting the first structure and the second structure to align the first tunnel and the second tunnel along a line of the cutting device.

BRIEF DESCRIPTION OF THE DRAWINGS

These and other advantages of the invention will become more apparent from the following description in view of the drawings. Similar structures illustrated in more than one figure are numbered consistently among the drawings.

DETAILED DESCRIPTION OF THE INVENTION

Figure 1:
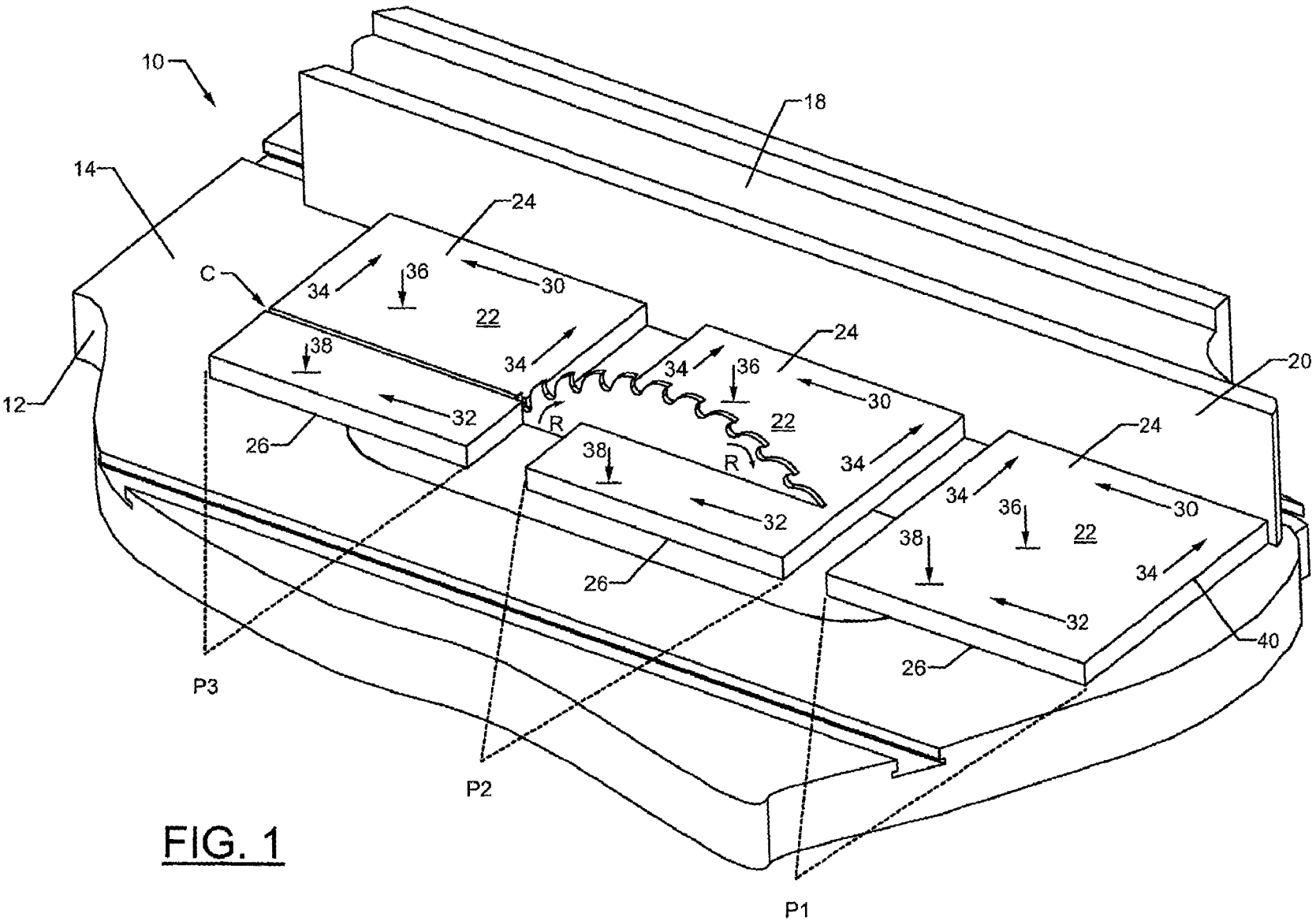
FIG. 1 is a perspective view of a table saw with a work piece in three positions to illustrate the forces exerted on the work piece during a sawing operation.

The inventor has analyzed the forces acting upon a work piece being moved over a table saw blade in order to identify the shortcomings of the prior art pusher designs and in order to evaluate the improved pusher apparatus described herein. FIG. 1 illustrates a table saw 10 including a table 12 with a flat horizontal surface 14 and a saw blade 16 having its top portion protruding above the table surface 14 through an opening formed in the table 12. A fence 18 connected to the table 12 includes a flat guide surface 20 oriented in a plane perpendicular to the table surface 14 and parallel to the saw blade 16. A work piece 22 is illustrated in three sequential positions P1, P2, P3 as it is moved past the saw blade 16. Position P1 illustrates the work piece 22 before it makes contact with the rotating saw blade 16. Position P2 illustrates the work piece 22 as it is being cut by the saw blade 16. Position P3 illustrates the work piece 22 as it is exiting the saw blade 16 after being cut into two pieces, commonly referred to as the inside cut portion 24 and the outside cut portion 26.

Arrows are used to illustrate the forces that should be exerted on the work piece 22 in order to ensure optimal control of the cutting process and to ensure the safety of the table saw operator. A pushing force is needed in a direction parallel to the direction of the cut C to force the work piece 22 past the saw blade 16. The pushing force should include separate components 30, 32 exerted on the inside cut portion 24 and outside cut portion 26, respectively. The rotation R of the saw blade 16 will create a force opposing pushing force 30, 32 proximate the leading edge of the saw blade 16 where the saw blade 16 is moving forward into the stock material.

Force 34 is necessary to keep the inside cut portion 24 in contact with the fence 18. Importantly, no force in the direction of force 34 should be exerted on the outside cut portion 26 in positions P2 and P3. Any such force acting on the outside cut portion 26 will cause the work piece 22 to engage the trailing portion of the saw blade 16 where it is traveling in an upward direction, thus causing binding of the saw blade 16, burning of the cut surface, and possible kickback of the work piece 22.

Downward forces 36, 38 must be exerted on the inside cut portion 24 and outside cut portion 26, respectively. Downward forces 36, 38 must be of sufficient magnitude proximate the saw blade 16 to overcome the tendency of the rotating saw blade 16 to fling the work piece 22 upward.

Simple prior art pushers, such as the one described above in U.S. Pat. No. 6,135,521, provide a downward force 36 proximate the trailing edge 40 of the work piece 22 where they engage the trailing edge of the work piece 22. Depending upon the length of the work piece 22 and the length of the pusher, the magnitude of such a force may be insufficient proximate the saw blade 16, and the work piece 22 may be lifted away from the table surface 14. Accordingly, downward force 38 and pushing force 32 must be provided by the operator's unprotected hand with the device of U.S. Pat. No. 6,135,521. It is particularly difficult for an operator to provide pushing force 32 in a direction exactly parallel to the line C of the cut, especially due to the tall, narrow structure of the device. Should the operator exert any force in a direction toward the saw blade 16, the work piece 22 will bind with the saw blade 16 and cause burning and possible kick back. This is especially dangerous when making a bevel cut, since the forces generated between the saw blade 16 and the inside cut portion 24 can be very large.

In addition to damaging the top surface of the work piece, prior art pushers of the style of U.S. Pat. No. 2,839,100 also rely on the operator's unprotected hand for providing forces 32, 38. As described above, this is not only unsafe, but it is difficult for the operator to properly maintain such forces without exerting any force toward the fence.

The hand guard described in U.S. Pat. No. 4,370,909 includes a heel for generating pushing force 30, 32, but it has no means for positively engaging the work piece 22 to provide force 34 for keeping the inside cut portion 24 in contact with the fence 18. Contact between the bottom surface of the hand guard and the top surface of the work piece is confined to a limited surface area, with the actual contact between these surfaces being further reduced by the inherent unevenness of the as-manufactured bottom surface of the hand guard. No provision is provided to prevent the work piece from slipping horizontally in relation to this prior art hand guard. Furthermore, depending upon the length of the work piece 22, the downward forces 36, 38 provided at the trailing edge portion of the work piece 22 by such a device may be insufficient to prevent kickback. The operator's unprotected second hand must be used to provide the missing forces for adequate control of the work piece 22.

Figure 2:
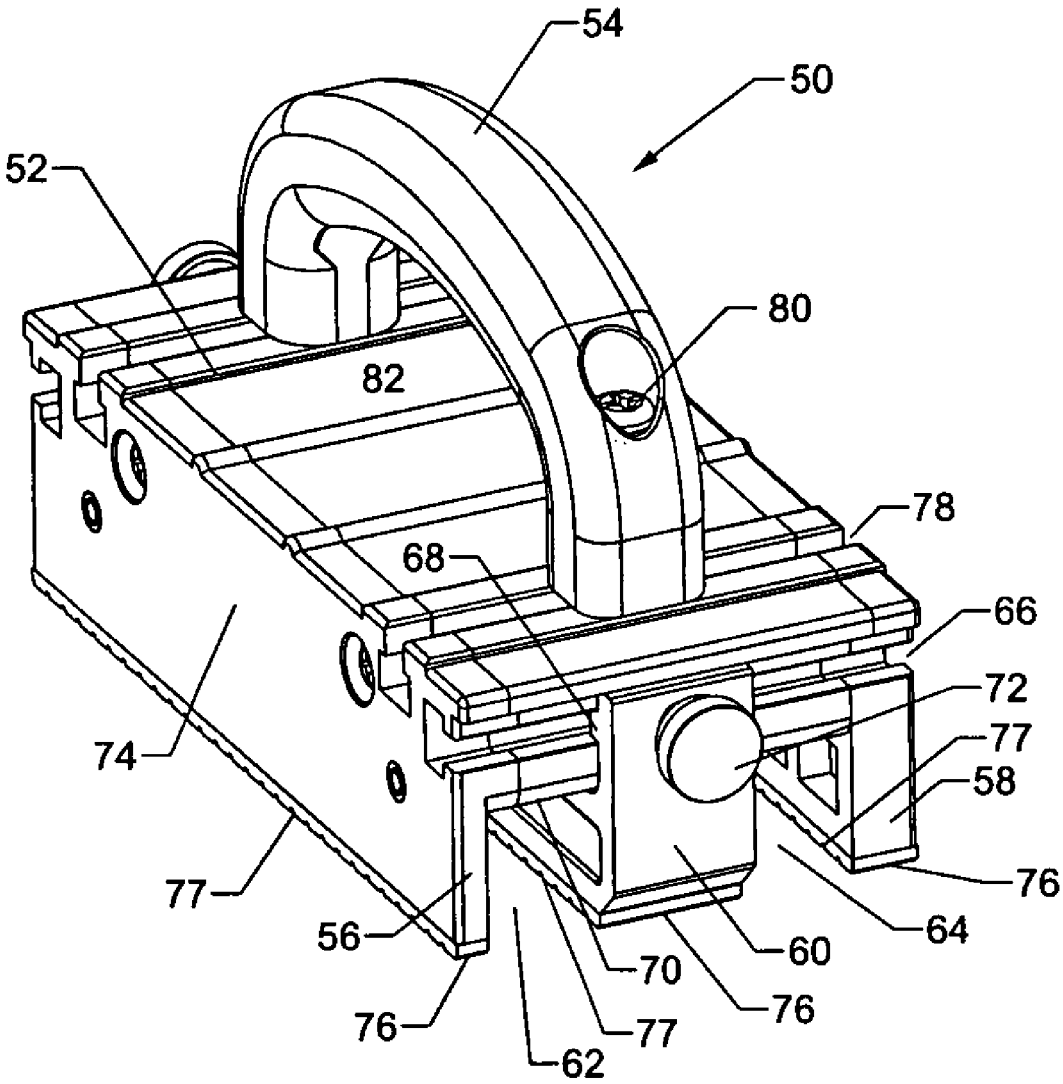
FIG. 2 is a perspective view of an apparatus for guiding a work piece through a cutting device in accordance with the present invention.

FIG. 2 illustrates an improved pusher apparatus 50 for guiding a work piece through a cutting device. The apparatus 50 includes a main body 52 to which other portions of the apparatus 50 are attached, either directly or indirectly. Other portions of the apparatus 50 include a handle 54, a first leg 56, a second leg 58 and a center leg 60. The apparatus 50 defines two tunnels 62, 64 through which a cutting device may pass when the apparatus 50 is used to push a piece of stock material. As will be described more fully below, the apparatus 50 may be assembled in several different configurations and may be used in several different manners to safely accomplish a variety of material-removal operations on a variety of sizes of material.

Apparatus 50 may be formed of component parts that can be attached or removed as desired. Body 52 is the structural base to which other components are attached, either directly or indirectly. Body 52 may be formed to include a slot or keyway 66 on opposed leading and trailing edges for receiving mating tongues or keys 68 formed on respective leading and trailing portions of center leg 60. Center leg 60 is assembled onto body 52 by sliding keys 68 into the opening slot of keyways 66 to position center leg 60 at a selected location along the underside 70 of body 52. The center leg 60 may be affixed at any selected location by tightening thumb screws 72 into mating nuts (not shown) located within the keyway 66, thereby drawing the keys 68 tight against the body 52. The location of center leg 60 defines the respective widths of tunnels 62,64.

First leg 56 and second leg 58 may be assembled onto the sides of body 52 by threading bolts through counter-bored holes in the respective leg into nuts embedded or otherwise retained in body 52. (hardware not shown in Figures) Each of the legs 56, 58 includes a flat side surface 74 adapted for abutting a flat guide surface of a saw table fence. Any mounting hardware exposed along the side surface 74 should be mounted flush or counter-bored below surface 74 so as not to interfere with the smooth movement of side surface 74 across a guide surface. Apparatus 50 may be assembled to include one or both of first leg 56 and second leg 58, depending upon the requirements of a particular operation. The legs 56, 58, 60 each extend away from the underside 70 of body 52 to form respective work piece-contacting surfaces 76. These work piece-contacting surfaces 76 are preferably non-slip surfaces, being formed from a material that does not easily slide over a work piece surface, for example rubber or a thermoplastic elastomer containing a plurality of recesses such as grooves 77. The term non-slip is used herein with its common usage meaning that two surfaces will tend to stick together when a force is applied there between. The term non-slip need not imply a specific coefficient of friction, but rather is meant to include surfaces that are generally soft and adhering, such as rubber or other elastomers. The term non-slip as used herein excludes hard smooth surfaces such as metal or plastic having no special surface treatment, but may include such materials if treated to have a degree of roughness for imparting a non-slip property when forced against a work piece. A typical molded plastic part surface will have an inherent unevenness and hardness such that it will provide a slip surface when pressed against a work piece such as wood. A non-slip material may be molded into or may be attached to the bottom of the respective leg 56, 58 with an adhesive, or a non-slip material may be partially embedded into the bottom surface of the legs, or the material of the legs may be sufficiently roughened to be non-slip. It is preferred that the non-slip material used to form work piece-contacting surface 76 be slightly recessed from the first and second leg side surfaces 74 so as not to interfere with the smooth movement of side surface 74 across a fence guide surface. In one embodiment, the non-slip surface may be an elastomer having a durometer measurement of 35–40. The elastomer is sufficiently soft that it will deform to accommodate the inherent unevenness of a molded plastic surface, thereby further increasing its non-slip property.

Body 52 and legs 56, 58 may include keyways 78 for capturing hardware used to attach handle 54 and/or other accessories. Handle 54 may be moved to any selected position between first leg 56 and second leg 58, then locked into place by tightening bolts 80. Bolt 80 passed through a hole formed in handle 54 and is threaded into a nut disposed within the keyway 78. As will be described more fully below, the location of handle 54 with respect to body 52 may be selected to most advantageously locate the point of application of forces to be applied by an operators hand on the handle 54. Handle 54 may be aligned to be parallel to leg side surface 74 or it may be fixed at an askew position so that the longitudinal axis of the handle 54 is disposed at an angle to the line of the saw blade 16.

The structural components of the apparatus 50 described above and below may be formed of plastic, metal, wood or other known materials of construction. In a preferred embodiment, the component parts are formed of structural foam injection molded plastic, with assembly hardware being formed of metal. Accidental contact between a cutting tool and a plastic apparatus part will not damage the cutting tool and may result in a lower risk of injury to an operator than would otherwise be the case if the apparatus part were formed of metal.

Figure 3:
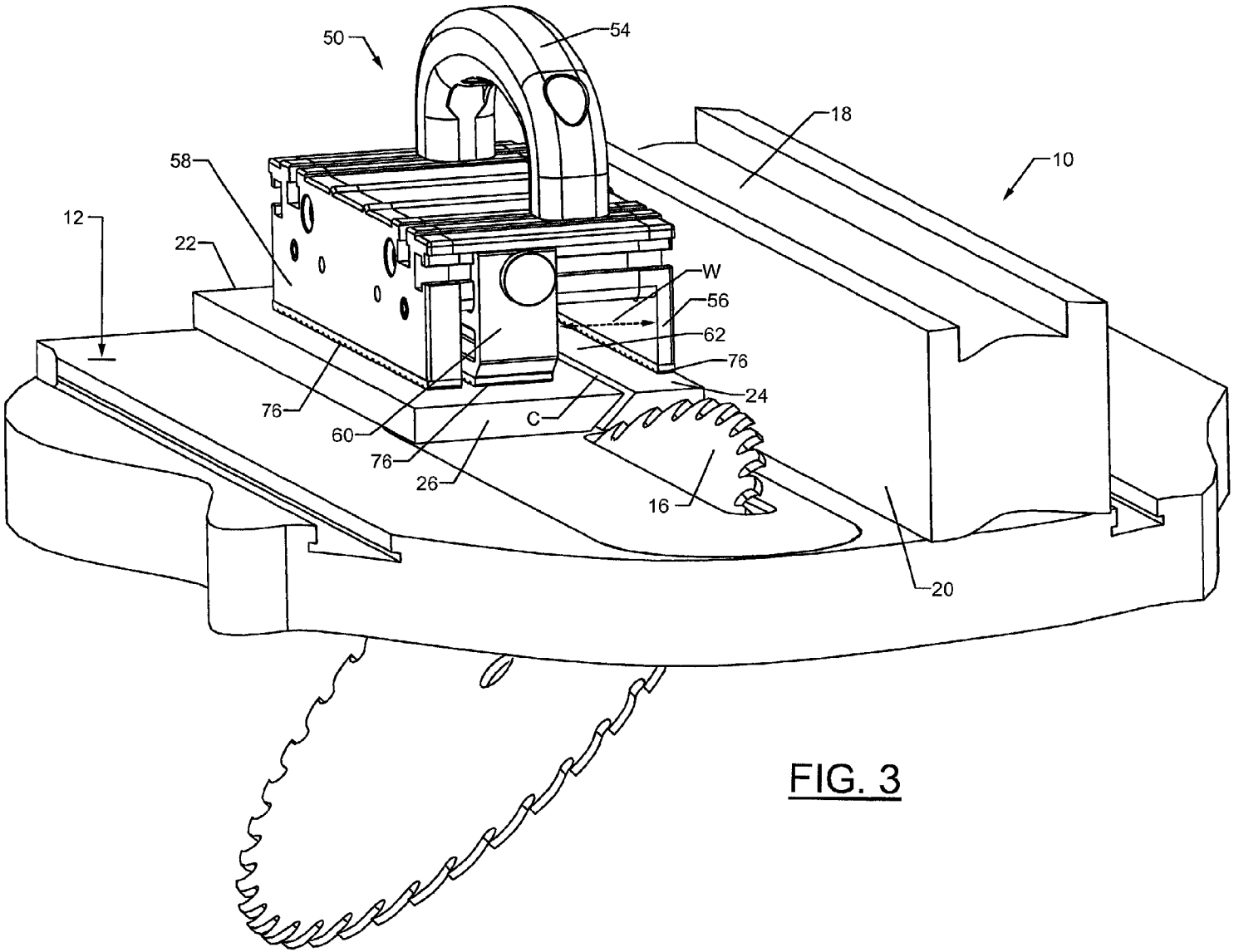
FIG. 3 is a perspective view of the apparatus of FIG. 2 being used to guide a piece of wood stock past a saw blade on a saw table.

The operation of apparatus 50 with a table saw 10 may be understood with reference made to FIG. 3. A work piece 22 of wood is positioned on a table 12, and is illustrated as having just been cut into an inside cut portion 24 and an outside cut portion 26 by saw blade 16. Apparatus 50 is positioned on the work piece 22 so that one of its tunnels 62 straddles the line of the cut C. Non-slip work piece-contacting surfaces 76 couple the apparatus 50 with the work piece 22 when the operator applies a downward force to handle 54. The operator is able to control the movement of work piece 22 past saw blade 16 by urging the handle 54 with a force vectored downward, toward fence guide surface 20, and forward along cut line C. The operator's hand is protected from the rotating saw blade 16 passing through tunnel 62 of apparatus 50. The side surface of first leg 56 provides guidance to maintain the movement of work piece 22 parallel to the desired line of cut C.

Apparatus 50 exerts all of the forces necessary for proper control of the work piece 22 as discussed above with reference to FIG. 1. The work piece-contacting surface 76 of first leg 56 provides downward force 36 and pushing force 30 on the inside cut portion 24. Apparatus 50 also exerts fence contacting 34 on inside cut portion 24 to keep the work piece 22 firmly against guide surface 20, without imparting any such force on outside cut portion 26. This is accomplished because apparatus 50 can move only parallel to guide surface 20, thus center and second leg work piece-contacting surfaces 76 can not urge outside cut portion 28 toward the line of the cut 0. Accordingly, binding of the saw blade 16 and the resulting burning of the cut surface and dangerous kickback forces are avoided. The work piece-contacting surfaces 76 of second leg 58 and center leg 60 also provide downward force 38 and pushing force 32 on the outside cut portion 26, without the need for the operator to touch the work piece 22 with an unprotected hand. Because apparatus 50 does not rely on a hook device engaging the edge of the work piece 22, it can be positioned closer to the leading edge of the work piece 22 to ensure that the downward forces exerted are sufficient to overcome any lifting force exerted by the saw blade 16 on the leading edge of the work piece 22.

Figure 4:
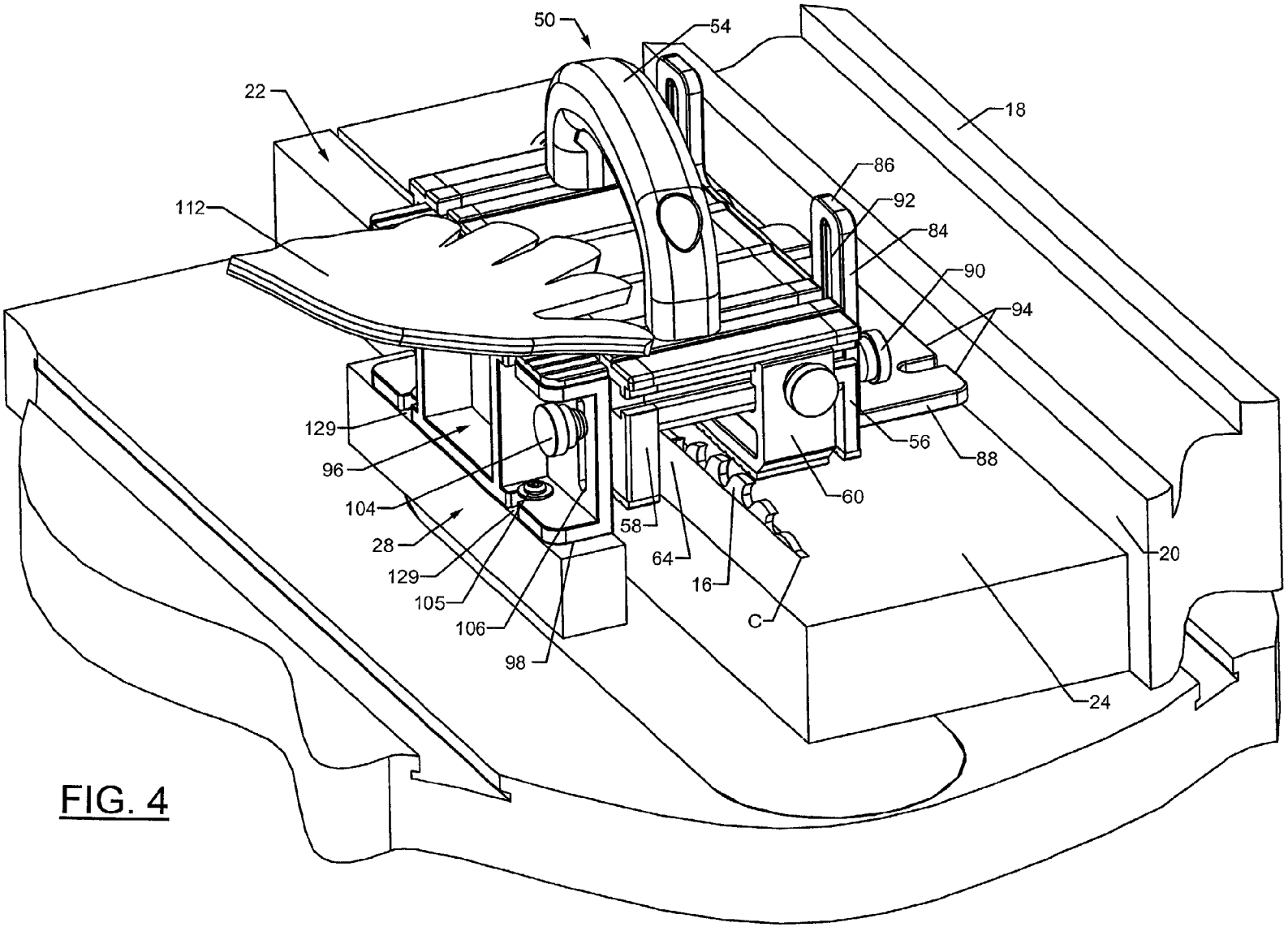
FIG. 4 is a perspective view of an apparatus for guiding a work piece through a cutting device and including a spacer for accommodating a relatively wide inside cut dimension and a balance device for accommodating a narrow outside cut dimension.

In the configuration of FIG. 3, center leg 60 is positioned against second leg 58 in order to maximize the width W of tunnel 62. This configuration is useful in this configuration because the table saw 10 is set up to make an angled cut in work piece 22, and thus the saw blade 16 protrudes from the work piece 22 toward first leg 56. Handle 54 is positioned generally over the line of the cut C to optimize the balance of the forces exerted upon the work piece 22. In this embodiment, first leg 56 has a width that is more narrow than the width of second leg 58, and first leg 56 is positioned to make contact with fence 18. In other configurations, it may be advantageous to position second leg 58 against fence 18, which can be accomplished by simply turning apparatus 50 in the opposite direction. For various cut dimensions, center leg 60 may be locked into any of a plurality of selected positions and the appropriate leg side surface 74 may be placed against guide surface 20 in order to locate cut line C within one of the tunnels 62, 64. Handle 54 may further be fixed in a position generally over the line of cut C or in any other position that facilitates a balance of forces and safe manipulation by the operator. It may be useful to align the front portion of the handle 54 to be somewhat closer to the fence 18 than is the rear portion of the handle 54, as illustrated in FIG. 4, so that the operator's action of pushing on the handle will naturally impart a force to the work piece in the direction toward the fence 18. In one embodiment, the top surface 82 (including top surfaces of legs 56, 58) may be approximately 3½ inches by 7 inches in size, the width of first leg 56 may be approximately ¼ inch, the width of second leg 58 may be approximately ½ inch, and the width of center leg 60 may be approximately 1 inch. Thus, a wide range of cut dimensions may be accommodated by appropriate movement of center leg 60 and handle 54, and with appropriate positioning of the apparatus 50 on table saw 10. One may appreciate that in other embodiments of this invention, the width of the tunnels 62, 64 may be made adjustable by providing a body having an adjustable width, or by providing one or both of the legs to have an adjustable width.

There may be certain stock materials and cut dimensions that are beyond the range of adjustment of a particular embodiment of body 52 and legs 56, 58, 60. One such situation is illustrated in FIG. 4, where a relatively wide inside cut portion 24 is desired. Even with center leg 60 moved all the way against first leg 56 or second leg 58, the position of tunnel 64 would not be properly over cut line C if the side surface of either first or second leg 56, 58 were placed directly against guide surface 20. To position apparatus 50 for this configuration, a spacer 84 is attached to the side surface 74 of first leg 56. Spacer 84 is illustrated in FIG. 4 as an L-shaped member having a generally vertical portion 86 connected to a generally horizontal portion 88. Spacer 84 is removeably connected to first leg 56 by thumb screw 90 which extends through an elongated slot 92 formed in spacer vertical portion 86 and is threaded into a nut (not shown) captured below the side surface 74 of first leg 56. Spacer horizontal portion 88 extends away from first leg 56 to form a spacer side surface 94 that is abutted against guide surface 20 to properly locate tunnel 64 over saw blade 16.

Figure 5:
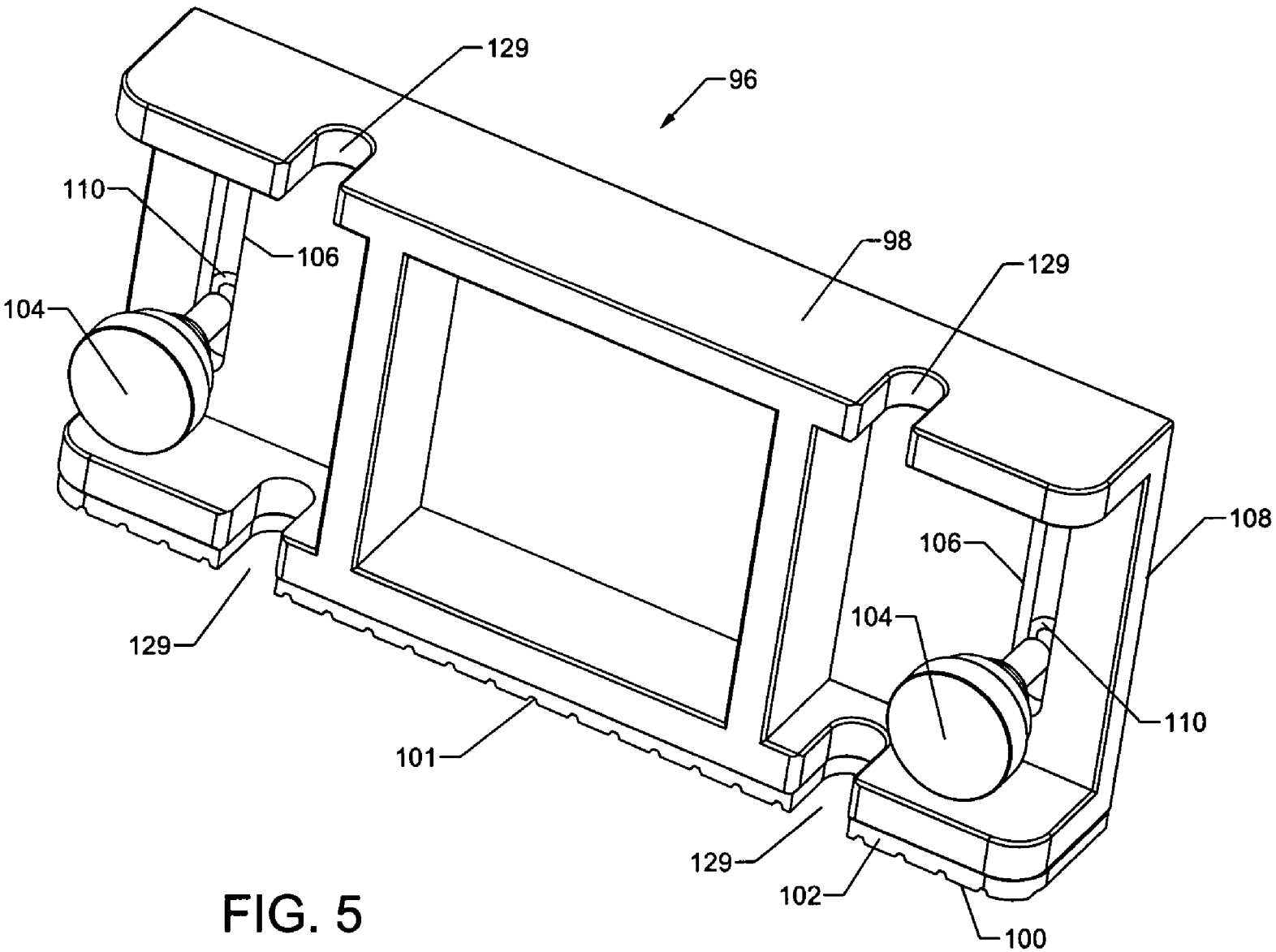
FIG. 5 is a perspective view of an embodiment of a spacer for use with the apparatus of FIG. 2.

Another embodiment of a spacer is illustrated in FIG. 5. Spacer 96 is formed to have a generally rectangular shape with a first work piece-engaging surface 98 opposed a second work piece-engaging surface 100. First work piece-engaging surface 98 may be plastic or other slip surface material, while opposed second work piece-engaging surface 100 may be a non-slip surface, such as is formed by an integrally molded layer 102 of rubber or other elastomer. The non-slip surface 100 may include a plurality of recesses such as grooves 101 formed therein. Spacer 96 is attached to the side surface 74 of either the first leg 56 or second leg 58 of the apparatus 50 of FIG. 2 by tightening thumbscrews 104 which pass through slots 106 formed in a spacer rear wall 108. Thumbscrews 104 may be retained within slots 106 when the spacer 96 is not attached to an apparatus 50 by providing rubber washers 110 over the threaded bolt portion of thumbscrews 104. The rubber washers 110 fit into a recessed counter-bore (not illustrated) formed either in the rear wall 108 of spacer 96 or in the side surface 74 of the attaching leg 56, 58. Advantageously, spacer 96 may be attached to an apparatus 50 with either first work piece-engaging surface 98 or second work piece-engaging surface 100 facing downward to form a spacer bottom surface to engage an underlying surface.

Figure 6:
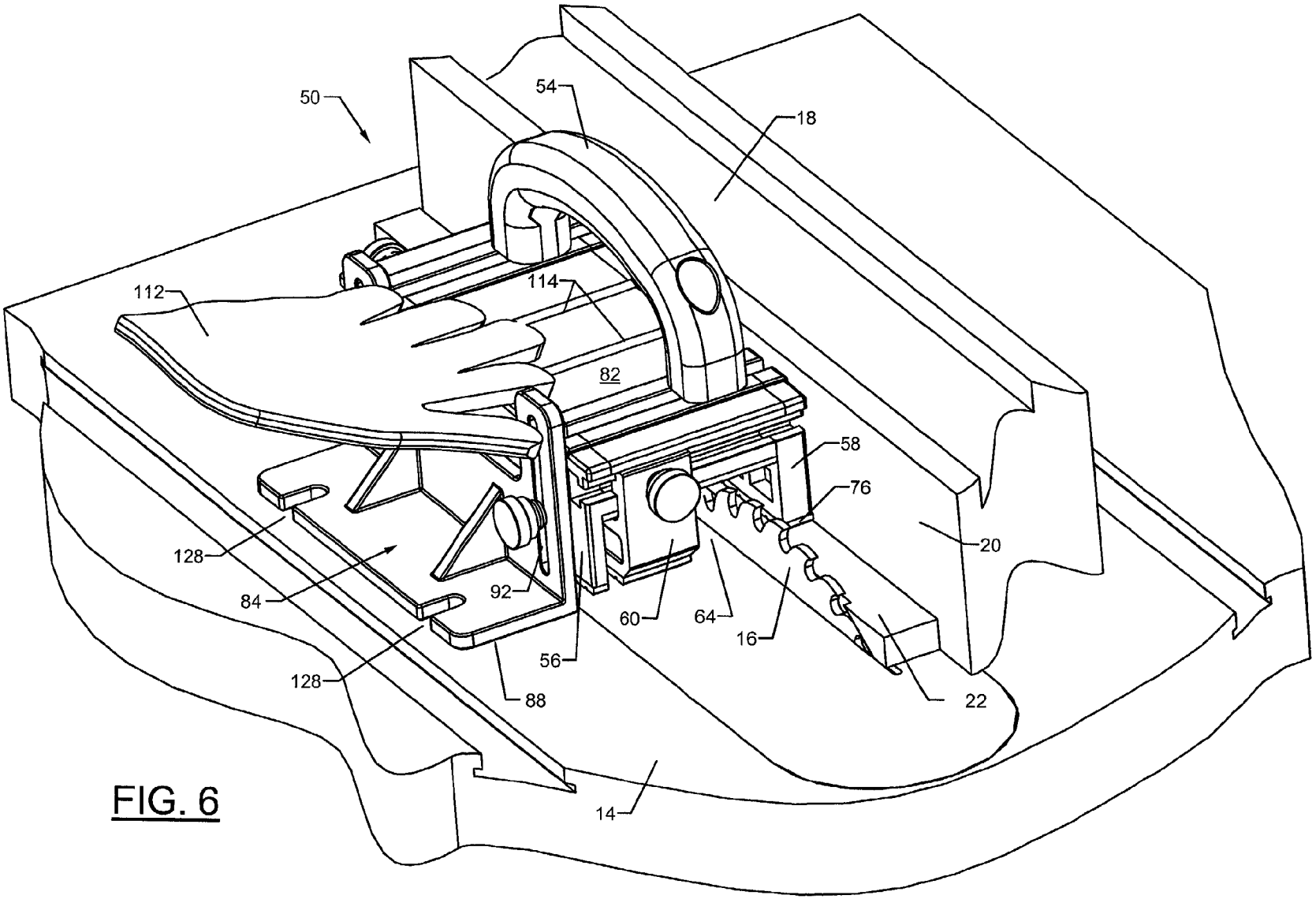
FIG. 6 is a perspective view of the apparatus of FIG. 4 being used in an opposite direction with one spacer removed on a narrow piece of stock material.

By providing vertically oriented slots 92, 106 for the passage of thumbscrews 90, 104, a spacer 84, 96 may be attached (directly or indirectly via first or second leg) to body 52 at any of a plurality of vertical heights. This feature may be used advantageously when the width of the work piece 22 is too narrow to properly engage both sides of tunnel 64 as illustrated in FIG. 6. In this configuration, a very narrow strip of material is being removed from work piece 22 by saw blade 16. Second leg 58 is placed onto the top of the work piece 22 and urged against the fence 18. The necessary downward, forward and fence-ward forces are applied to the work piece 22 through second leg non-slip work piece-contacting surface 76. Center leg 60 and handle 54 are positioned so that the saw blade 16 is approximately centered within tunnel 64 and under handle 54. However, no portion of work piece 22 extends under second leg 60 or first leg 56 to keep apparatus 50 level. In this configuration, spacer 84 is attached to first leg 56 in a vertical position that extends the bottom support surface of the spacer horizontal portion 88 to an elevation that is below the plane of work piece-contacting surfaces 76 to make contact with the table surface 14. In this configuration, the spacer 84 acts as a balancer to keep the apparatus 50 level as the work piece 22 is moved past the saw blade 16. In one embodiment, slots 92 provide sufficient vertical movement of spacer 84 to accommodate stock material having a thickness of about 2 inches. For thicker stock material, an additional piece of spacer material 28, as shown in FIG. 4, can be attached under the spacer 84, 96 to further extend a bottom surface of the spacer downward. Such additional piece of material 28 may be connected by passing connectors 105 through slots 128,129 and into the spacer material 28.

Apparatus 50 protects the operator's first hand (not illustrated) as it is placed on the handle 54. The operator may place a second hand 112 on the balance support/spacer 84 and/or on the body 52 to provide additional force against apparatus 50. The body top surface 82 may include ribs 114 or other non-slip structures or materials to provide additional gripping action for the operator's second hand 112.

Figure 7:
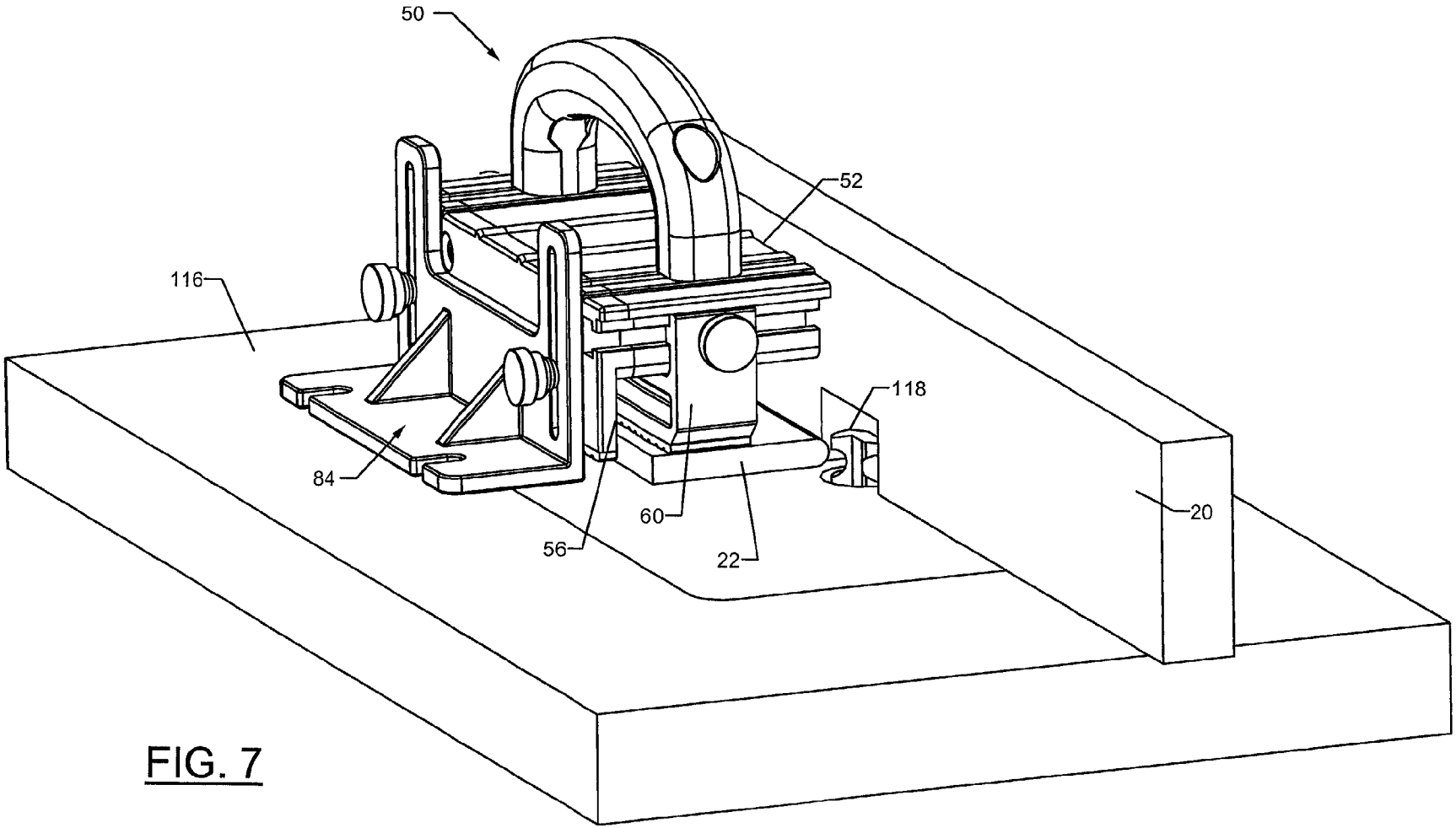
FIG. 7 is a perspective view of an apparatus for guiding a work piece through an edge profile cutting device in accordance with the present invention.

FIG. 7 illustrates the use of apparatus 50 with the first leg 56 and center leg 60 in place, but with the second leg 58 removed. This configuration is especially useful when the apparatus 50 is used on a router table 116 for making an edge profile cut on work piece 22. The side of body 52 is formed to be a surface for sliding along the guide surface 20. Center leg 60 provides contact with the work piece 22 to move it past cutter 118. Removal of the second leg 58 avoids contact between the apparatus 50 and the cutter 118. The spacer 84 may be used as a balance support for keeping the apparatus 50 level during the edge profile operation.

Figure 8:
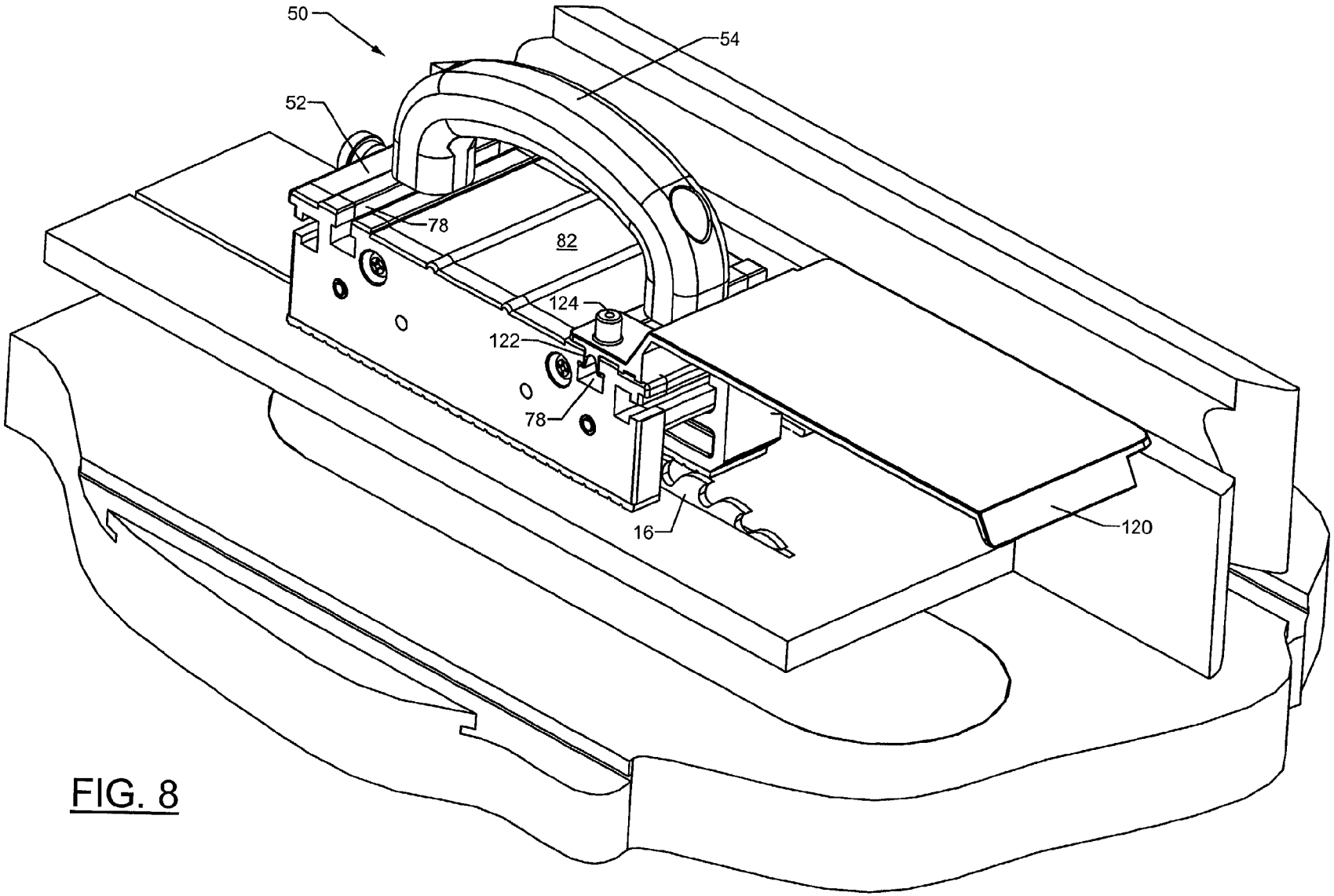
FIG. 8 is a perspective view of the apparatus of FIG. 2 being used with an accessory dust shield.

Another accessory that may be used with apparatus 50 is a shield such as dust shield 120, as illustrated in FIG. 8. As apparatus 50 is moved past the saw blade 16, sawdust generated by the cutting operation may be blown away from the blade 16 toward an operator's face. While eye protection is recommended when using any power tool, the cloud of sawdust may still be an unpleasant distraction for the operator. Dust shield 120 is provided with a connector such as key 122 formed to slide into one of the keyways 78 used to attach handle 54. Dust shield 120 may be formed of a polycarbonate material, and key 122 may therefore have a spring property that maintains a tight, yet moveable fit in keyway 78. The dust shield 120 may be supported from this single key 122 and allowed to rest along its leading edge against the top surface 82 of body 52. A small gripping knob 124 may be provided to facilitate the sliding of key 122 into and out of keyway 78. Although primarily functioning to direct sawdust away from an operator's face, dust shield 120 also provides some additional protection for the operator's forearm as the apparatus 50 is moved past the saw blade 16.

Figure 9:
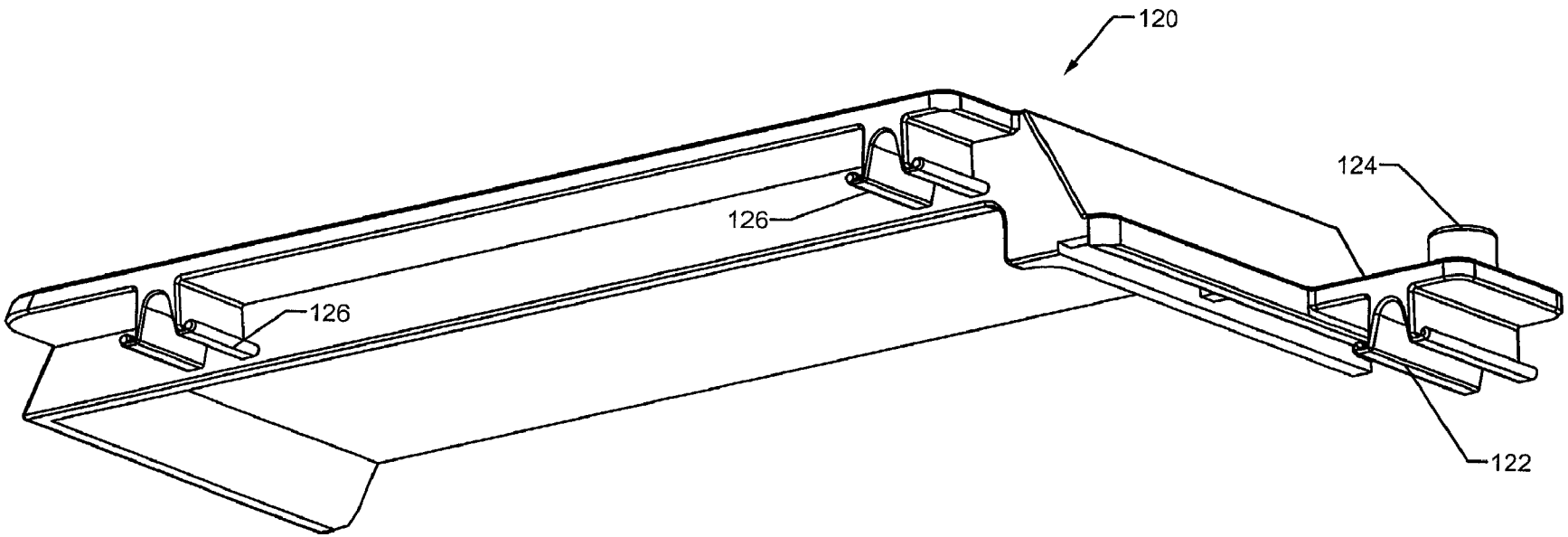
FIG. 9 is a perspective view showing an underside of the dust shield of FIG. 8.

Dust shield 120 may be provided with an alternative connector, such as a second set of keys 126 on its underside, as illustrated in FIG. 9. These keys 126 are used to secure dust shield 120 in an alternative position relative to the body 52, along side either the first leg 56 or second leg 58, by inserting keys 126 into the keyways 78 used for handle 54. This location of dust shield 120 may be especially useful when using apparatus 50 to guide a work piece 22 into a cutter 118 on a router table 116 that does not include a fence 18. In this configuration, the dust shield 120 would extend away from body 52 and over cutter 118, and should therefore be formed of a clear material to allow the operator to view the edge cutting operation through the dust shield 120.

Spacers 84, 96 may be provided with open-ended slots 128, 129 as illustrated in FIGS. 5 and 6. These slots may be used to removeably attach additional accessories, such as stabilizing plate 130 illustrated in FIG. 10. Stabilizing plate 130 is a generally flat plate of material having two parallel horizontal slots 132 formed therein for receiving respective bolts 134 and wing nuts 136. The heads of bolts 134 (not shown) are captured in a counter bore formed on the underside of stabilizing plate 130 so that the bolts do not rotate as the wing nuts are tightened. Stabilizing plate 130 is installed as a horizontal extension under spacer 84 and under first leg 56 so that the plate 130 can be adjusted horizontally with respect to spacer 84, 96. Shoulder washers 138 installed on the bolts 134 are sized to fit snugly into open-ended slots 128 so that the plate 130 does not fall away from spacer 84 as it is being adjusted horizontally and before wing nuts 136 are tightened. The position of bolts 134 within slots 132 is adjusted so that an edge 140 of the stabilizing plate 130 is moved to one of a plurality of horizontal positions to abut an edge of work piece 22, thereby providing additional support for the safe movement of the work piece 22. A trailing edge hook 142 may be used to provide an additional means for conveying a pushing force against the work piece 22. Such a hook 142 may be provided on only one edge 140 of the stabilizing plate 130 so that the stabilizing plate 130 may be positioned proximate an edge of a work piece 22 or remote from any edge of the work piece 22, as illustrated by the two different configurations of FIG. 10.

Figure 10:
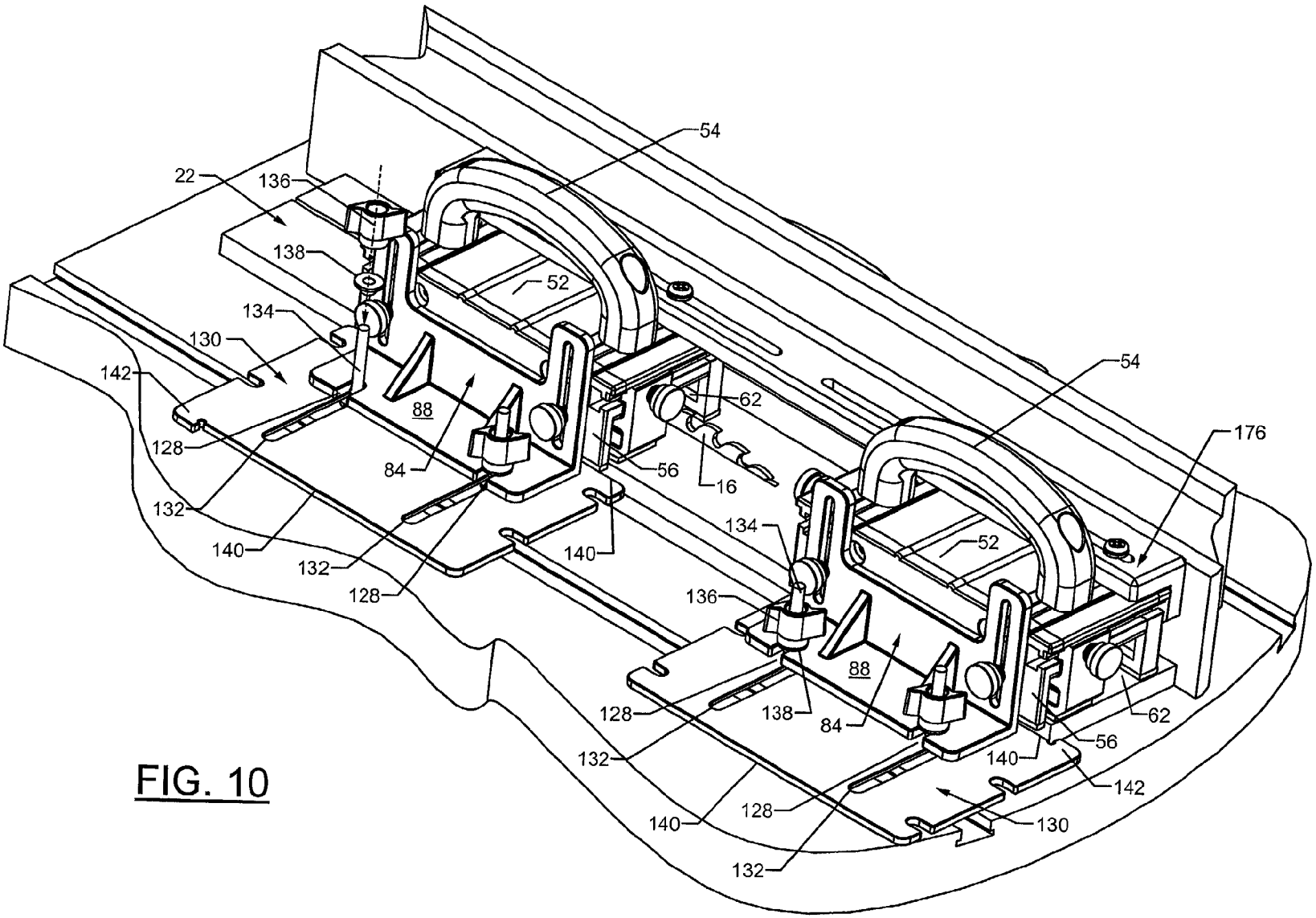
FIG. 10 is a perspective view of an apparatus for guiding a relatively long work piece through a cutting device.

FIG. 10 also illustrates how two individual structures may be attached together to form an apparatus for guiding a long piece of stock material through a cutting device. A bridge 176 may be connected between two respective bodies 52 to align respective tunnels 62 along a single cut line so that saw blade 16 passes first through one of the tunnels 62 then through the second tunnel 62. In this manner, the operator can apply the necessary forces to the work piece 22 as the cut progresses simply by using one hand on each respective handle 54 or by moving hands from one handle 54 to the next as the cut progresses. Any number of bodies 52 may be connected in this manner to accommodate any length work piece 22.

Figure 11:
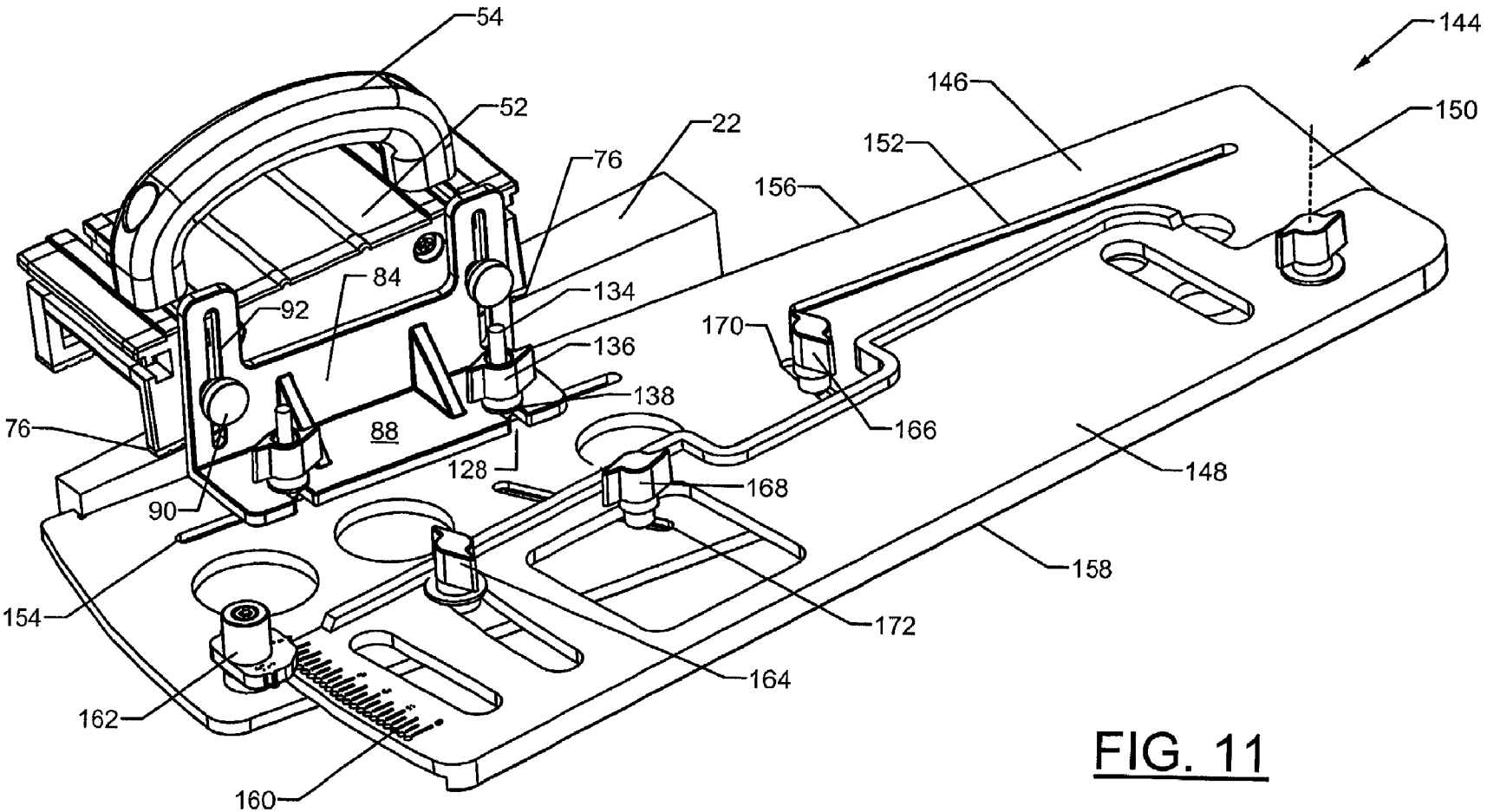
FIG. 11 is a perspective view of a tapering accessory for use with the apparatus of FIG. 2 as seen in a tapering configuration.
Figure 12:
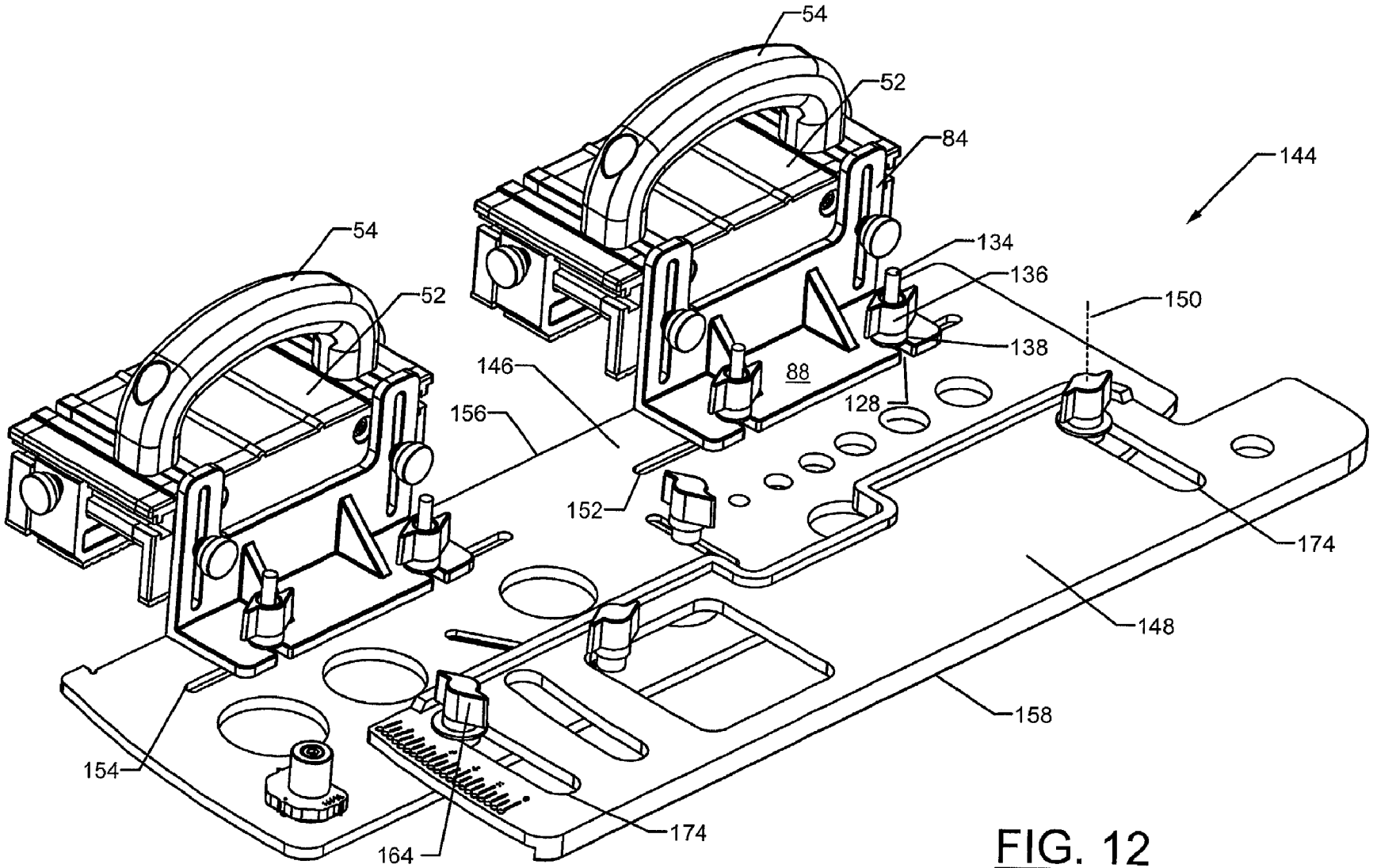
FIG. 12 is a perspective view of a tapering accessory for use with the apparatus of FIG. 2 as seen in a jointing configuration.

FIGS. 11 and 12 illustrate a tapering device 144 that may be attached as part of apparatus 50 for making saw cuts along a line that is not parallel to an opposed edge of the stock material. Such taper cuts are known to be useful for making tapered table legs, for example. Tapering device 144 includes a bottom plate 146 and a top plate 148 pivotally joined at pivot axis 150. Bottom plate 146 is attached to spacer 84 by bolts 134 and wing nuts 136 passing through slots 152, 154, with first edge 156 extending under spacer 84 to make parallel contact with an edge of the work piece 22. Top plate 148 may be moved such that second edge 158 forms a selected angle with respect to first edge 156 and with respect to the edge of work piece 22. The angle there between may be indicated by the relative location of markings 160. Once top plate 148 is positioned in such a tapering configuration to a selected angle, locking knob 164 is tightened to fix the two plates 146, 148 in their relative positions. The apparatus 50 is pushed downward to engage a work piece 22 with the second edge 158 abutting a table saw fence 18, thus creating a cut line C that is angled with respect to the edge of the work piece 22 that abuts first edge 156. Note that when making such a cut, the saw blade 16 will pass at an angle through selected tunnel 62, 64. Accordingly, it may be desirable to make the selected tunnel 62, 64 as wide as possible, including the possibility of using apparatus 50 with at least one of the legs 56, 58, 60 removed. FIG. 11 illustrates apparatus 50 with only first leg 56 and second leg 58 installed.

When making a taper cut on two opposed sides of the same piece of stock material, one may appreciate that the set-up for the second cut must include consideration of the taper that was previously made on the first side of the material. Thus, tapering device 144 may be set to 2° for a first cut, then 4° for a second cut on the opposed side of the same piece of material. When making multiple such pieces, it may be necessary to repeatedly change the setting of tapering device 144 from one angle to another. To facilitate such an operation, two memory stops 166, 168 are provided on bottom plate 146. A first angle is selected and first memory stop 166 is moved in slot 170 to abut top plate 148 and locked into position. A second, greater angle is then selected and second memory stop 168 is moved in slot 172 to abut top plate 148 and locked into position. The device 144 may then be quickly switched between the first angle and the second angle by simply loosening locking knob 164, sliding top plate 148 until it abuts either first memory stop 166 or second memory stop 168, then again tightening locking knob 164.

FIG. 11 shows work piece 22 as already being tapered on all four surfaces so the height of the work piece 22 varies along the line of the cut. Bottom plate 146 rests upon the horizontal table surface 14 (not shown in this view) and work piece contacting surface 76 rests upon the non-horizontal top surface of work piece 22. To accommodate this configuration, the position of the two thumbscrews 90 will be located at different vertical elevations within respective slots 92 to position body 52 at an angle with respect to horizontal. Thus, spacer 84 serves to keep work piece contacting surface 76 parallel to and in full contact with the work piece 22.

Tapering device 144 is illustrated in FIG. 12 in a parallel configuration where it may be used as part of apparatus 50 as a jointing device. Top plate 148 is moved to a new position on bottom plate 146 so that bolts and wing nuts that were used in the configuration of FIG. 11 at pivot axis 150 and locking knob 164 are now located within respective elongated straight slots 174. In this manner, second edge 158 may be located at a plurality of selected distances remote from and parallel to first edge 156. Second edge 158 may thus extend past an uneven edge of a work piece 22 when apparatus 50 is held against the work piece 22 so that a straight jointing cut may be made on the work piece 22.

Tapering device 144 may also be used as a bridge for cutting long pieces of stock material. This can be accomplished by connecting a first body 52 to tapering device 144 via spacer 84 at slot 154 and connecting a second body 52 to tapering device 144 at slot 152, in a manner similar to the way that stabilizing plates 130 are attached in FIG. 10. In this configuration, tapering device 144 provides a second function as a bridge. The operator may then place one hand on each respective handle 54 to engage a long work piece with the entire assembly moving as a single apparatus.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

The invention claimed is:

1. An apparatus for guiding a work piece through a cutting device, the apparatus comprising:

a structure defining a tunnel through which a cutting device may pass, the structure comprising at least two work piece-contacting surfaces that are co-planar relative to a top surface of a work piece for applying a downward and forward directed force to the top surface of the work piece on each of two opposed sides of a cut line defined by movement of the cutting device as the work piece is urged through the cutting device by the force; and a handle attached to the structure and moveably fixable at any one of a plurality of positions along a width of the structure vertically above and horizontally between the two work piece-contacting surfaces to accommodate a plurality of cut geometries by positioning the handle directly above the cut line as the structure and work piece move past the cutting device;

further comprising the handle being moveably fixable at a position wherein a longitudinal axis of the handle is disposed at an angle relative to a longitudinal axis of the tunnel.

2. An apparatus for guiding a work piece through a cutting device, the apparatus comprising:

a body having a top and an underside opposed the top;

a first leg attached to the body and forming a first side surface, the first side surface defining a flat side of the apparatus adapted for abutting and being slid along a flat guide surface of a fence of a saw table, the first leg extending below the underside of the body to a first leg work piece-contacting surface perpendicular to the first side surface and parallel to a top surface of a work piece for contacting and moving the work piece as the fiat side of the apparatus is slid along the guide surface of The fence when the work piece is disposed on the saw table;

a center leg attached against the underside of the body and extending below the underside of the body to a center leg work piece-contacting surface perpendicular to the first side surface and parallel to The surface of the work piece for additionally contacting the work piece top surface as the flat side of the apparatus is slid along the guide surface of the fence, the center leg moveable to a plurality of positions relative to the first side surface to form a first tunnel having a selected width through which a cutting device of the saw table may pass when the work piece is moved through the cutting device by the apparatus, the first tunnel defined by the first leg, the center leg and the underside of the body;

a second leg attached to the body and forming a second side surface, the second leg extending below the underside of the body to a second leg work piece-contacting surface perpendicular to the first side surface and parallel to the surface of the work piece for additionally contacting the work piece top surface as the fiat side of the apparatus is slid along the guide surface of the fence;

wherein the center leg is moveable to a plurality of positions between the first leg and the second leg to form a second tunnel having a selected width through which the cutting device alternatively may pass as the work piece is moved through the cutting device, the second tunnel defined by the second leg, the center leg and the underside of the body; and a handle moveably attached to the top of the body and fixable in any one of a plurality of positions vertically above and horizontally between the first and second legs on either side of or directly over the center leg to position The handle at a selected location for balancing forces exerted onto the work piece relative to a cut line as the apparatus is used to urge the work piece through the cutting device.

3. The apparatus of claim 2, further comprising the first leg having a width different than a width of The second leg.

4. The apparatus of claim 2, further comprising a non-slip surface formed on each of the first work piece-contacting surface and the center work piece-contacting surface.

* * * * *